US005237360A

United States Patent [19]

Patton

[11] Patent Number: 5,237,360

[45] Date of Patent: Aug. 17, 1993

[54] APPARATUS FOR PROCESSING PHOTOSENSITIVE MATERIALS

[75] Inventor: David L. Patton, Webster, N.Y.

[73] Assignee: Eastman Kodak Company, Rochester, N.Y.

[21] Appl. No.: 714,302

[22] Filed: Jun. 12, 1991

[51] Int. Cl.[5] ..... G03D 3/02

[52] U.S. Cl. ..... 354/324

[58] Field of Search ..... 354/324, 322, 319, 320

[56] References Cited

U.S. PATENT DOCUMENTS

| | | | |
|---|---|---|---|
| 3,832,730 | 8/1974 | Geyken et al. | 354/299 |
| 3,852,793 | 12/1974 | McClintock | 354/299 |
| 4,316,663 | 2/1982 | Fischer | 354/299 |
| 4,984,004 | 1/1991 | Yoda et al. | 354/317 |
| 5,040,013 | 8/1991 | Kurokawa et al. | 354/324 X |

*Primary Examiner*—D. Rutledge

*Attorney, Agent, or Firm*—Marianne J. Twait; Ronald Reichman

[57] ABSTRACT

A photographic processing apparatus for processing a photosensitive material with a processing solution including first and second processing ingredients includes a processing tank for holding the processing solution and for processing the photosensitive material. The used processing solution is discharged from the processing tank into a separator where the second processing ingredient is removed from the processing solution leaving the first processing solution. The first processing solution is circulated back to the processing tank.

2 Claims, 1 Drawing Sheet

APPARATUS FOR PROCESSING PHOTOSENSITIVE MATERIALS

TECHNICAL FIELD

The invention relates generally to the field of photography: and in particular to a photographic processing apparatus.

BACKGROUND ART

A drawback of mixing together processing ingredients, for example a developer fluid with an activator, is the creation of an unstable processing solution. The unstable processing solution will have a tendency to deteriorate over a short period of time, thus will have to be flushed out of a photographic processing apparatus and discarded. This type of photographic processing apparatus is unattractive especially for a minilabs environment due to large amounts of effluent which have to be discarded.

DISCLOSURE OF INVENTION

According to the invention, there is provided a photographic processing apparatus intended to process a photosensitive material with a processing solution including first and second processing ingredients. The photographic processing apparatus includes a processing tank for holding the processing solution, the processing tank having an outlet to discharge the processing solution from the tank, and means connected to the outlet for separating the processing solution discharged from the processing tank into first and second processing ingredients. The photographic processing apparatus further includes means connected to the separating means for returning the first processing ingredient but not a second processing ingredient to said processing tank after the two ingredients are separated by the separating means. The photographic processing apparatus of the present invention produces minimal effluent which would require discarding.

BRIEF DESCRIPTION OF DRAWING

Other advantages of the invention will become apparent from the following description taken in connection with the accompanying drawing wherein.

MODE OF CARRYING OUT THE INVENTION

Figure 1:
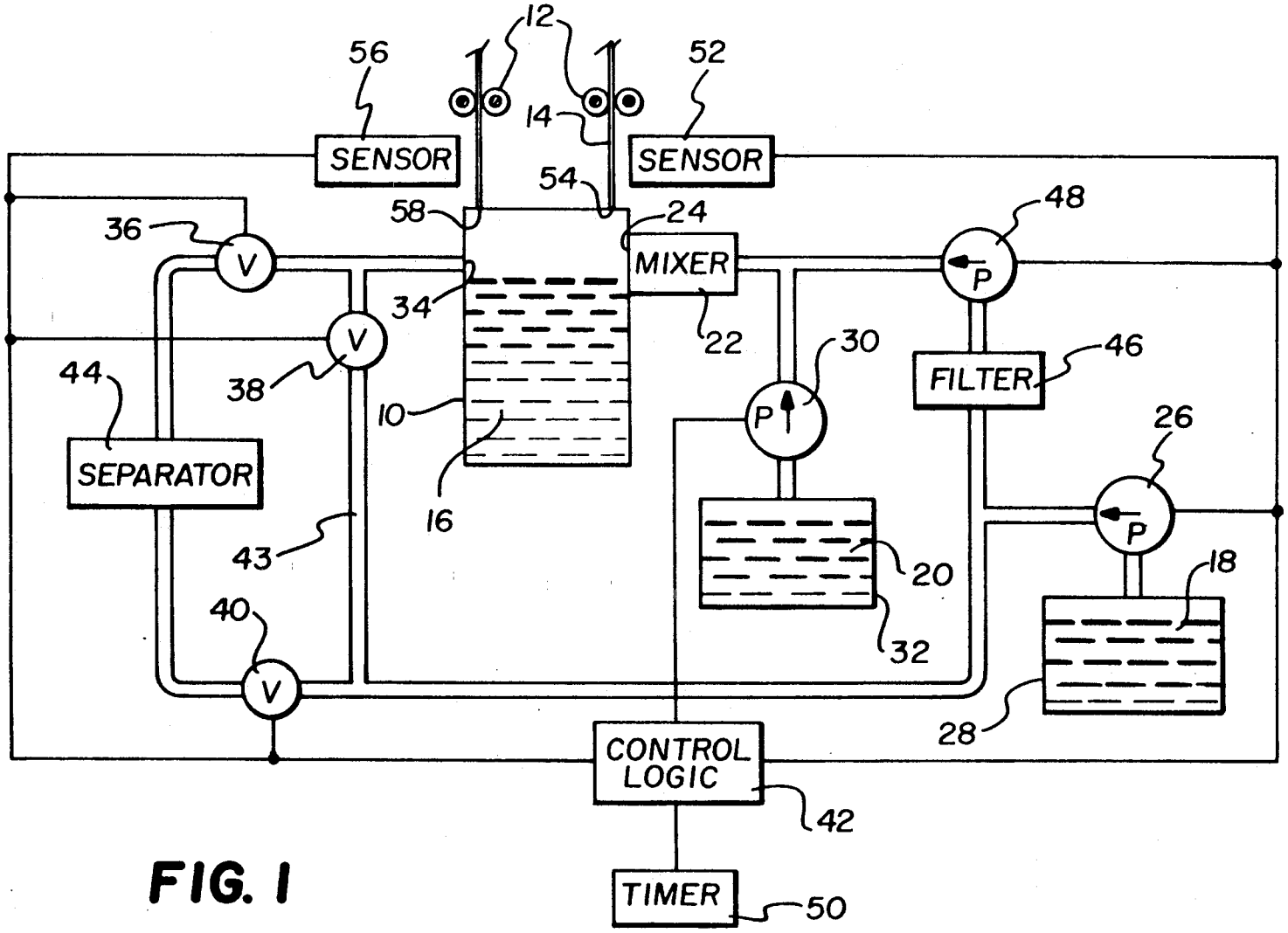
FIG. 1 is a schematic of a photographic processing apparatus in accordance with the present invention.

Because photographic processors and the general operations associated therewith are well known in the art, the description hereinafter will be directed in particular only to those processor parts relevant to the present invention. It is to be understood, however, that processor components not specifically shown or described may take various forms selectable from those known in the art.

Referring now to the drawing, a photographic processing apparatus includes a processing tank 10 having means 12 to transport a photosensitive material 14, film or paper, through the processing tank 10. Any conventional transporting means can be utilized. The processing tank 10 can take any form well known to a person skilled in the art or can take the form of what is commonly referred to as a thin walled tank. A thin walled tank requires a relatively small amount of a processing solution to process a photosensitive material.

The photosensitive material 14 is processed as it is transported through the processing tank 10 by a processing solution 16 comprising a first processing ingredient 18 and a second processing ingredient 20. For example, the first processing ingredient can be a developer fluid and the second processing ingredient can be an activator. The developer fluid and the activator are mixed together to form the processing solution and then added to the processing tank 10.

According to a preferred embodiment, the first and second processing ingredients 18,20 are blended together by a mixer 22 connected to an inlet 24 of the processing tank 10. The first processing ingredient 18 is circulated to the mixer 22 by a replenisher pump 26 from a first processing ingredient replenisher tank 28. The second processing ingredient 20 is circulated to the mixer 22 by a replenisher pump 30 from a second processing ingredient replenisher tank 32.

The processing solution 16 created by blending the first and second processing ingredients 18,20 is discharged from the processing tank 10 through an overflow outlet 34. Valves 36,38 connected to the overflow outlet 34 and valve 40 control the circulation path of the processing solution 16 which is dependent upon a photosensitive material 14 being transported through the processing tank 10. Valves 36,38,40 are controlled by a conventional control logic circuit 42.

Valves 36,40 are closed and valve 38 is open to permit processing solution 16 to circulate through pipe 43 when the photosensitive material 14 is being transported through the processing tank 10 for processing. Valve 38 is closed and valves 36,40 are open to permit processing solution 16 to circulate through a separating means 44 when the photosensitive material is not being transported through the processing tank 10. A first sensor 52 located near a photosensitive material entrance 54 detects when the photosensitive material 14 is inserted into the processing tank 10. A second sensor 56 located near a photosensitive material exit 58 detects the end of the photosensitive material 14 being transported through the processing tank 10.

The separator 44 removes by any conventional means such as filtering, scrubbing, chemical reaction, etc. the second processing ingredient 20 from the processing solution 16 leaving the first processing ingredient 18 to be discharged from the separator 44 and circulated through open valve 40, through a conventional filter 46 and pump 48 to the processing tank 10. Since it is possible that not all of the second processing ingredient 20 is removed from the processing solution 16, the processing solution 16 will continue to circulate through the separator 44 for a predetermined amount of time generally determined by a timer 50. The predetermined amount of time is dependent on the rate of replenishment of the second processing ingredient 20 to the mixer 22 during processing of the photosensitive material 14.

The operation of the photographic apparatus during processing of the photosensitive material 14 will first be described. For purposes of the description of the operation of the photographic apparatus, the first processing ingredient 18 will be designated a developer 18 and the second processing ingredient will be designated an activator 20.

The developer and activator replenishment pumps 26,30 and the pump 48 are turned on by the control logic 42 when the first sensor 52 detects the photosensitive material 14 entering the processing tank 10. Valve 38 is also opened at this time and valves 36 and 40 are closed. The developer 18 is pumped from the developer replenisher tank 28 by the replenisher pump 26 through the filter 46 and pumped to the mixer 22 by the pump 48. The activator 20 is metered into the mixer 22 from the activator replenisher tank 32 by the activator replenisher pump 30. The developer 18 and the activator 20 are blended together by the mixer 22 forming the processing solution 16 which is discharged into the processing tank 10.

The photosensitive material 14 is processed by the processing solution 16 as it is transported through the processing tank 10. The reaction between the photosensitive material 14 and the processing solution 16 causes some of the developer 18 and most of the activator 20 to be used up during the processing step. Therefore, the developer 18 and the activator 20 will be continually metered to the mixer 22 while the photosensitive material is being transported through the processing tank 10.

The processing solution 16 is discharged from the processing tank 10 through the overflow outlet 34. The processing solution 16, which includes essentially all developer 18 at this time, circulates through valve 38 and pipe 43 to the filter 46. The filter 46 removes dirt, dust, or photosensitive material particles which have collected in the processing solution 16. The processing solution 16 is then pumped to the mixer 22 and blended with fresh activator 20 and fresh developer 18 and is discharged into the processing tank 20.

Valves 36 and 40 are opened and valve 38 is closed when the second sensor 56 detects the end of the photosensitive material 14 leaving the processing tank 10. The developer and activator replenishment pumps 26,30 are turned off at this time. Therefore, the processing solution 16 leaving the processing tank 10 will flow through valve 36 into the separator 44. The separator 44 removes the activator 20 from the processing solution 16 leaving the developer 18 to be circulated through the processing apparatus. The processing solution 16 leaving the processing tank 10 will continue to flow through the separator 44 for a predetermined time period until all the activator 20 is removed from the processing solution 16.

The remaining developer 16 will continue to flow through valve 40, filter 46 and will be pumped to the processing tank 10 by the pump 48 until the first sensor 52 detects the photosensitive material 14 entering the processing tank 10.

It should be noted that the activator 20 can be metered to the mixer 22 at such a rate that the processing solution 16 will include a substantial amount of activator 20 when the processing solution 16 is discharged from the processing tank 10. Due to the possibility that the activator 20 mixed with the developer 18 can create an unstable processing solution which can begin to deteriorate in a relatively short amount of time it is desirable to remove the activator 20 from the processing solution 16 before the processing solution 16 is returned to the processing tank during processing of the photosensitive material 14. Therefore, the processing solution 16 should be circulated through the separator 44 so that the activator 20 can be removed from the processing solution 16 leaving the developer 18 to be returned to the processing tank 10.

The photographic apparatus described above includes a replenishment and recirculation system which eliminates the need to discard large amounts of unstable chemistry everytime photographic processing is stopped. The only ingredient which would require discarding would be the second processing ingredient which is removed from the processing solution by the separator. Furthermore, the first processing ingredient will have the tendency to maintain the cleanliness of the processing tank, the pumps, the pipes, the filter and the valves as it is circulated through the photographic processing apparatus when no photosensitive material is being processed. The recirculation of the first processing ingredient will also maintain the required temperature of the first processing ingredient, if needed.

The present invention has been described in detail with particular reference to a preferred embodiment thereof, but it will be understood that variations and modifications can be effected within the spirit and scope of the invention.

I claim:

1. A photographic processing apparatus intended to process a photosensitive material with a processing solution including first and second processing liquids, said processing apparatus comprising:

a processing tank for holding a processing solution including first and second processing liquids, said processing tank having an outlet for discharging the processing solution from said processing tank;

means connected to said outlet of said processing tank for separating a processing solution discharged from said processing tank into first and second processing liquids;

means connected to said separating means for returning a first processing liquid, but not a second processing liquid, to said processing tank after the two liquids are separated by said separating means;

means for adding a second processing liquid to said processing tank when a first processing liquid is returned by said returning means to said processing tank;

means for transporting a photosensitive material through said processing tank;

a sensor to detect when a photosensitive material is no longer being transported through said processing tank; and means for directing a processing solution discharged from said processing tank to said separating means when said sensor detects that a photosensitive material is no longer being transported through said processing tank.

2. A photographic processing apparatus as defined in claim 1, wherein said directing means includes a first valve connected to said outlet of said processing tank and control means responsive to said sensor for actuating said first valve.

* * * * *